US010991317B2

(12) United States Patent
Byun

(10) Patent No.: US 10,991,317 B2
(45) Date of Patent: Apr. 27, 2021

(54) DISPLAY DEVICE AND METHOD FOR CONTROLLING LUMINANCE THEREOF

(71) Applicant: LG Display Co., Ltd., Seoul (KR)

(72) Inventor: Minchul Byun, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 30 days.

(21) Appl. No.: 16/532,039

(22) Filed: Aug. 5, 2019

(65) Prior Publication Data

US 2020/0143751 A1 May 7, 2020

(30) Foreign Application Priority Data

Nov. 2, 2018 (KR) ..... 10-2018-0133355

(51) Int. Cl.
*G09G 3/32* (2016.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0439* (2013.01); *G09G 2310/08* (2013.01); *G09G 2320/0233* (2013.01)

(58) Field of Classification Search
CPC ..... G09G 2300/0439; G09G 2310/027; G09G 2310/0294; G09G 2310/08; G09G 2320/0233; G09G 2320/0285; G09G 2320/046; G09G 2330/025; G09G 3/3233; G09G 3/3291
USPC ..... 345/82–87, 473, 545, 589, 690–694
See application file for complete search history.

(56) References Cited

U.S. PATENT DOCUMENTS

2006/0007250 A1* 1/2006 Jung ..... G09G 3/2944 345/690
2007/0211083 A1* 9/2007 Lee ..... G09G 3/3406 345/690
2008/0111886 A1* 5/2008 Bai ..... H04N 5/144 348/173
2008/0224966 A1* 9/2008 Cok ..... G09G 3/32 345/82
2010/0079473 A1* 4/2010 Choi ..... G09G 3/3648 345/545
2011/0157209 A1* 6/2011 Saito ..... G09G 3/20 345/589
2012/0057084 A1* 3/2012 Sano ..... G09G 3/3611 348/790
2012/0162280 A1* 6/2012 Yamashita ..... G09G 3/3258 345/690

(Continued)

FOREIGN PATENT DOCUMENTS

KR 10-2003-0021668 A 3/2003
KR 10-2008-0092581 A 10/2008

(Continued)

*Primary Examiner* — Tony O Davis
(74) *Attorney, Agent, or Firm* — Polsinelli PC

(57) ABSTRACT

A display device comprises a display panel where an input image including a moving image and a still image is displayed; a controller configured to generate a gain for decreasing a peak luminance of the still image and modulate a pixel data of the still image by the gain; and a display panel drive circuit configured to write the pixel data received from the controller to sub-pixels of the display panel, wherein the gain is set to be a different value on a different position on the display panel.

13 Claims, 16 Drawing Sheets

(56) References Cited

U.S. PATENT DOCUMENTS

| | | | | |
|---|---|---|---|---|
| 2013/0016135 | A1* | 1/2013 | Wang | G09G 3/3233 345/690 |
| 2013/0038621 | A1* | 2/2013 | Choi | G06T 1/60 345/589 |
| 2014/0028739 | A1* | 1/2014 | Takahashi | G09G 3/3648 345/690 |
| 2015/0035875 | A1* | 2/2015 | Jeon | G09G 5/10 345/691 |
| 2016/0171931 | A1* | 6/2016 | Liu | G09G 3/3208 345/694 |
| 2016/0173770 | A1* | 6/2016 | Fosodeder | G01S 7/52098 348/77 |
| 2017/0004753 | A1* | 1/2017 | Kim | G09G 3/3233 |
| 2017/0193643 | A1* | 7/2017 | Naruse | H04N 5/361 |
| 2017/0345358 | A1* | 11/2017 | Xu | G09G 3/2022 |
| 2018/0082660 | A1* | 3/2018 | Xu | G09G 3/3208 |
| 2018/0182357 | A1* | 6/2018 | Yun | G09G 5/10 |
| 2018/0204539 | A1* | 7/2018 | Yang | G06F 1/1652 |
| 2018/0288308 | A1* | 10/2018 | Furumochi | H04N 5/353 |
| 2018/0365802 | A1* | 12/2018 | Onomura | G06T 5/001 |
| 2019/0180679 | A1* | 6/2019 | Choi | G09G 3/3208 |
| 2019/0213953 | A1* | 7/2019 | Koh | G09G 3/3406 |
| 2020/0013333 | A1* | 1/2020 | Hwang | G09G 3/3275 |
| 2020/0143751 | A1* | 5/2020 | Byun | G09G 3/3233 |

FOREIGN PATENT DOCUMENTS

| | | | |
|---|---|---|---|
| KR | 10-2010-0129551 | A | 12/2010 |
| KR | 10-2014-0094681 | A | 7/2014 |
| KR | 10-2015-0107995 | A | 9/2015 |

* cited by examiner

| Position | Before TPC | After TPC |
|---|---|---|
| Ln | 92.8% | 97.5% |
| $L\frac{n}{2}$ | 100.0% | 100.0% |
| L1 | 109.2% | 104.2% |
| Min | 92.8% | 97.5% |
| Max | 109.2% | 104.2% |
| Max/Min | 117.7% | 106.9% |

DISPLAY DEVICE AND METHOD FOR CONTROLLING LUMINANCE THEREOF

CROSS-REFERENCE TO RELATED APPLICATION

This application claims the benefit of Korean Patent Application No. 10-2018-0133355 filed on Nov. 2, 2018, which is incorporated herein by reference in its entirety.

BACKGROUND

Field of the Disclosure

The present disclosure relates to a display device, and more particularly, to a display device and a method of manufacturing the same. Although the present disclosure is suitable for a wide scope of applications, it is particularly suitable for preventing decrease in lifetime of pixels when a still image is displayed for a long time and improving luminance uniformity across the entire display area of the display device, and a method for controlling the luminance thereof.

Description of the Background

Electroluminescence displays can be classified into inorganic light-emitting displays and organic light-emitting displays depending on the material of an emission layer. Of these, an active-matrix organic light emitting display comprises organic light-emitting diodes (hereinafter, "OLED"), which emit light by themselves, and has advantages of fast response time, high luminous efficiency, high brightness, and wide viewing angle.

An organic light-emitting display reproduces an input image using self-luminous elements such as OLEDs. An OLED comprises an anode, a cathode, and an organic compound layer situated between these electrodes. The organic compound layer includes a hole injection layer (HIL), a hole transport layer (HTL), an emission layer (EML), an electron transport layer (ETL), and an electron injection layer (EIL). When a voltage is applied to the anode and cathode of the OLED, a hole passing through the hole transport layer HTL and an electron passing through the electron transport layer ETL move to the emission layer EML, forming an exciton. As a result, the emission layer EML can generate visible light.

However, pixels of a display device may deteriorate when a still image with high brightness is displayed for a long time on the display device. Particularly, the pixels of an organic light-emitting display device may deteriorate at a fast rate because large current flows when they display a high-brightness image, and this can lead to a shorter lifetime.

SUMMARY

Accordingly, the present disclosure is directed to a display device and a method of manufacturing the same that substantially obviate one or more of problems due to limitations and disadvantages of the prior art.

Additional features and advantages of the disclosure will be set forth in the description which follows and in part will be apparent from the description, or may be learned by practice of the invention. Other advantages of the present disclosure will be realized and attained by the structure particularly pointed out in the written description and claims hereof as well as the appended drawings.

To achieve these and other advantages and in accordance with the purpose of the present invention, as embodied and broadly described, a display device capable of preventing a decrease in the lifetime of pixels when a still image is displayed for a long time and improving luminance uniformity across the entire screen, and a method for controlling the luminance thereof.

In an aspect of the present disclosure, a display device includes a display panel where an input image including a moving image and a still image is displayed; a controller configured to generate a gain for decreasing a peak luminance of the still image and modulate a pixel data of the still image by the gain; and a display panel drive circuit configured to write the pixel data received from the controller to sub-pixels of the display panel, wherein the gain is set to be a different value on a different position on the display panel.

In another aspect of the present disclosure, a method for controlling the luminance of a display device incudes determining whether an input image is a still image; and lowering a peak luminance of sub-pixels on a display panel of a display device, while data for the still image is inputted, by modulating a pixel data of the input image with a gain set to a different value for a different position on the display panel.

In a further aspect of present disclosure, a display device includes a display panel where an input image including a moving image and a still image is displayed; a controller configured to calculate an amount of current required for the display panel for every frame period based on the pixel data, generate a gain for decreasing a peak luminance of the still image, and modulate a pixel data of the still image by the gain; and a display panel drive circuit configured to write the pixel data received from the controller to sub-pixels of the display panel, wherein the gain is set to be a different value on a different position on the display panel, and the peak luminance and the current are gradually lowered in the sub-pixels while the still image is displayed.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings.

DETAILED DESCRIPTION

Figure 1:
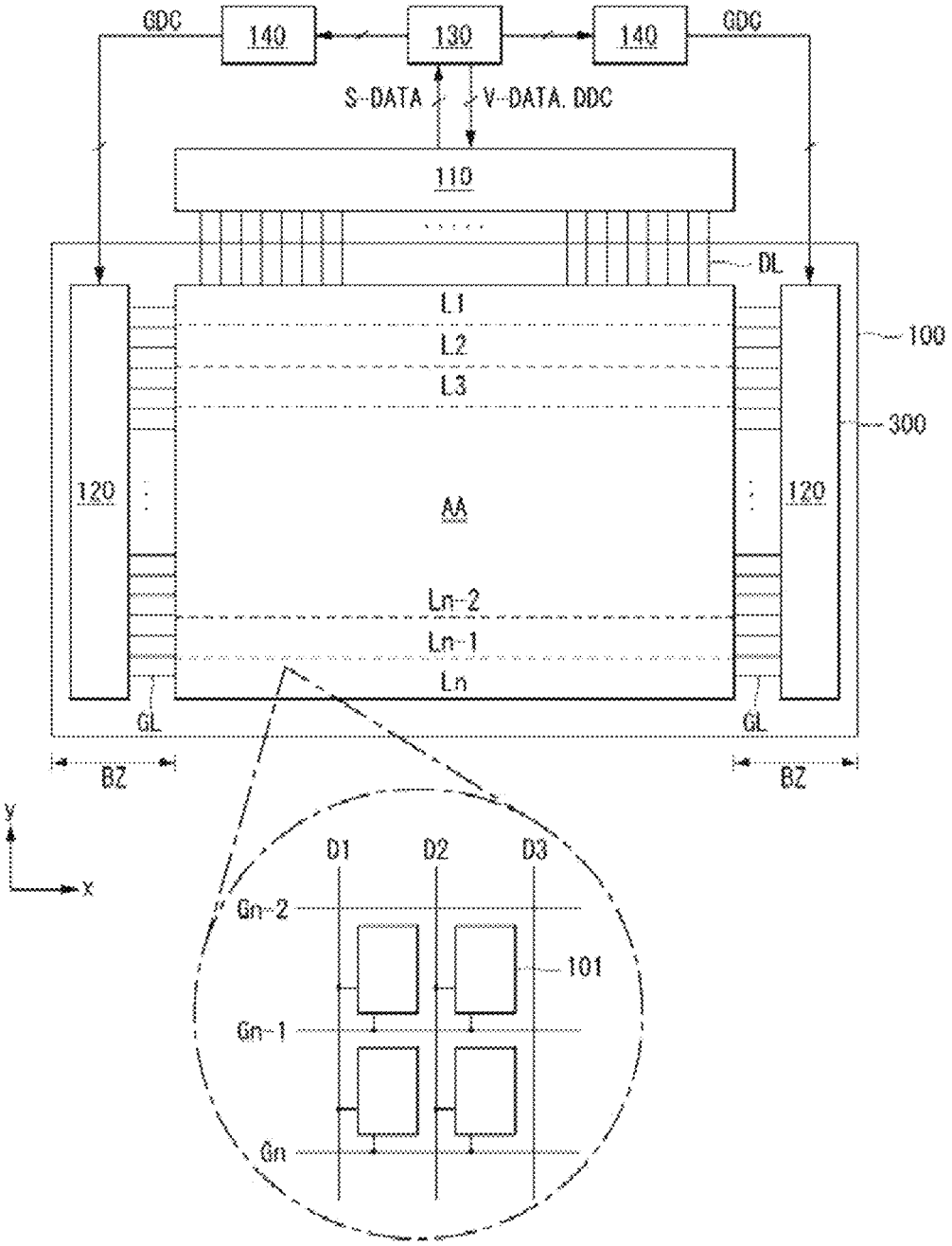
FIG. 1 is a block diagram showing a display device according to an aspect of the present disclosure.

Various aspects and features of the present disclosure and methods of accomplishing them may be understood more readily by reference to the following detailed descriptions of aspects and the accompanying drawings. The present disclosure may, however, be embodied in many different forms and should not be construed as being limited to the aspects set forth herein. Rather, these aspects are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the aspects of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure.

When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms "on", "over", "under", "next to" and the like, one or more parts may be positioned between the two parts as long as the term "immediately" or "directly" is not used.

The terms "first", "second", etc. may be used to distinguish one element from another. However, the functions or structures of the elements are not limited by the ordinal numbers attached to the beginning of the elements or the names of the elements. Ordinal numbers used in the detailed description may or may not match the ordinal numbers used for elements in the claims as the claims recite essential elements.

The features of various aspects of the present disclosure may be coupled or combined with one another either partly or wholly, and may technically interact or work together in various ways. The aspects may be carried out independently or in association with one another.

Hereinafter, various aspect of the present disclosure will be described in detail with reference to the accompanying drawings. In the aspects below, an organic light-emitting display will be described with respect to an organic light-emitting display, but is not limited to it.

FIG. 1 is a block diagram showing a display device according to an aspect of the present disclosure.

Referring to FIG. 1, the display device according to an aspect of the present disclosure includes a display panel 100 and a display panel drive circuit.

The display panel 100 includes a screen AA where an input image is reproduced. The screen AA includes a pixel array by which pixel data for an input image is displayed. The pixel array includes a plurality of data lines DL, a plurality of gate lines GL intersecting the data lines DL and a plurality of pixels.

The pixels may be arranged on the screen AA in a matrix form defined by the data lines DL and gate lines GL. As well as the matrix form, the pixels may be arranged on the screen AA in various fashions, such as by a shape for sharing pixels emitting light of the same color, a stripe shape and a diamond shape.

If the pixel array has a resolution of m*n, the pixel array has m pixel columns (m is a positive integer equal to or greater than 2) and n pixel lines L1 to Ln (n is a positive integer equal to or greater than 2) intersecting the pixel columns. The pixel columns has pixels arranged along the y axis. A pixel line includes pixels arranged along the x axis. 1 vertical period is 1 frame period which is required to write one frame of pixel data to all pixels on the screen—that is, the time required to write 1 line of pixel data sharing a gate line to 1 pixel line of pixels. 1 horizontal period is 1 frame period divided by m pixel lines L1 to Lm.

Each pixel may be divided into a red sub-pixel, a green sub-pixel, and a blue sub-pixel for color representation. Each pixel may further comprise a white sub-pixel. Each sub-pixel 101 comprises the same pixel circuit.

In an organic light-emitting display, a pixel circuit may include a light-emitting element, a driving element, one or more switching elements, and a capacitor. The light-emitting element may be implemented as an OLED which emits light by a current from a pixel driving voltage ELVDD. The current in the OLED may be adjusted by the gate-source voltage of the driving element. The driving element and the switching elements may be implemented as transistors. The pixel circuit is connected to a data line DL and a gate line GL. In FIG. 1, "D1 to D3" shown in the circle are data lines, and "Gn−2 to Gn" shown therein are gate lines.

Touch sensors may be placed on the display panel 100. Touch input may be sensed using touch sensors or through pixels. The touch sensors may be implemented as on-cell type- or add-on type touch sensors which are placed on the screen AA of the display panel 100, or as in-cell type touch sensors which are embedded in the pixel array.

The display panel drive circuit comprises a data driver 110 and a gate driver 120. The display panel drive circuit writes pixel data of an input image to pixels on the display panel 100 under control of a timing controller (TCON) 130.

The data driver 110 converts pixel data DATA of an input image, received from the timing controller 130, into analog gamma-compensated voltages by using a digital-to-analog converter (hereinafter, "DAC") to produce pixel data voltages. The data driver 110 supplies the data voltages to the data lines DL. The pixel data voltages are supplied to the data lines DL and applied to the pixel circuits of the sub-pixels 101 through the switching elements.

The gate driver 120 may be formed in a bezel area BZ on the display panel 100, where no image is displayed. The gate driver 120 sequentially supplies gate signals to the gate lines GL, in synchronization with the data voltages under control of the timing controller 130. The gate signals simultaneously select pixel lines to charge with the data voltages.

The gate driver 120 outputs a gate signal and shifts the gate signal by using one or more shift registers. The gate signal may comprise one or more scan signals and an emission control signal EM.

The timing controller 130 receives an input image's pixel data V-DATA and timing signals synchronized with the pixel data V-DATA from a host system (not shown). The timing signals comprise a vertical synchronization signal Vsync, a horizontal synchronization signal Hsync, a clock signal DCLK, and a data enable signal DE. The vertical synchronization signal Vsync and the horizontal synchronization signal Hsync may be omitted because vertical periods and horizontal periods are detected by counting data enable signals DE.

The host system may be one of a TV (television), a set-top box, a navigation system, a personal computer PC, a home theater system, a mobile device, and a wearable device. In the mobile device or the wearable device, the data driver 110, the timing controller 130, and the level shifter 140 may be integrated in one drive IC.

The timing controller 130 may control the operation timing of the display panel drivers 110 and 120 by multiplying the frame frequency (Hz) of an input image i times (i is a positive integer greater than 0). The frame frequency is 60 Hz in the NTSC (National Television Standards Committee) system and 50 Hz in the PAL (Phase-Alternating Line) system.

The timing controller 130 generates a data timing control signal DDC for controlling the operation timing of the data driver 110 and a gate timing control signal GDC for controlling the operation timing of the gate driver 120, based on the timing signals Vsync, Hsync, and DE received from the host system 150.

Figure 5:
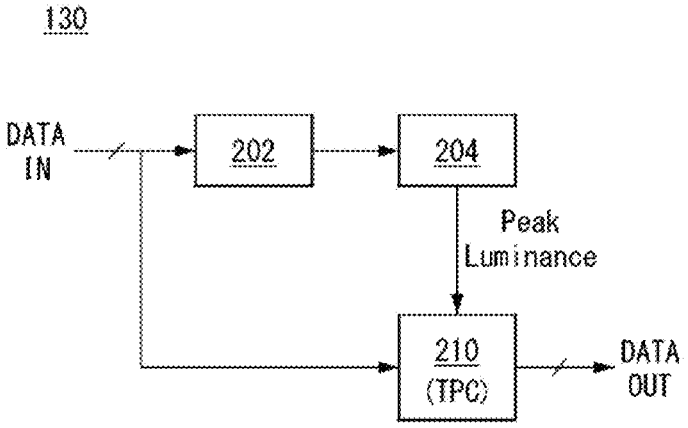
FIG. 5 is a view showing a luminance controller according to an aspect of the present disclosure.

The timing controller 130 analyzes an input image using the circuit shown in FIG. 5, generates a gain for decreasing the peak luminance of the input image if the input image is a still image, and modulates pixel data with the gain. The pixel data V-DATA outputted from the timing controller 130 is sent to the data driver 110.

The level shifter 140 converts the voltage of the gate timing control signal GDC outputted from the timing controller 130 to gate-on voltage and gate-off voltage and supplies them to the gate driver 120. The low-level voltage of the gate timing control signal GDC is converted to gate-low voltage VGL, and the high-level voltage of the gate timing control signal GDC is converted to gate-high voltage VGH.

The electrical characteristics of the pixels of the organic light-emitting display, such as the threshold voltage Vth of the driving element, the electron mobility μ of the driving element, temperature variation of the driving element, and the threshold voltage of the OLED, should be the same for every pixel since they serve as factors for determining the drive current Ids. However, the electrical characteristics may vary between pixels, due to various causes such as process variation, temporal change, etc., in the pixel array. The variations in the electrical characteristics of each pixel may lead to image quality degradation and reduced lifespan. To reduce deterioration of the pixels and lengthen the lifespan, internal compensation and external compensation may be applied.

In the internal compensation method, a compensation circuit placed in a pixel circuit is used to sample the threshold voltage of the driving element and compensate for the gate-source voltage of the driving element by an amount equal to the threshold voltage. In the external compensation method, variations in electrical characteristics between sub-pixels are compensated for by sensing the electrical characteristics of each sub-pixel through a sensing path connected to each sub-pixel and modulating the input image's pixel data based on the sensing results.

In the external compensation method, sensing data voltages outputted from the data driver 110 may be supplied to the data lines. The sensing data voltages are voltages that are preset regardless of the input image's data, with which the gate of the driving element and the capacitor are charged.

Figure 2:
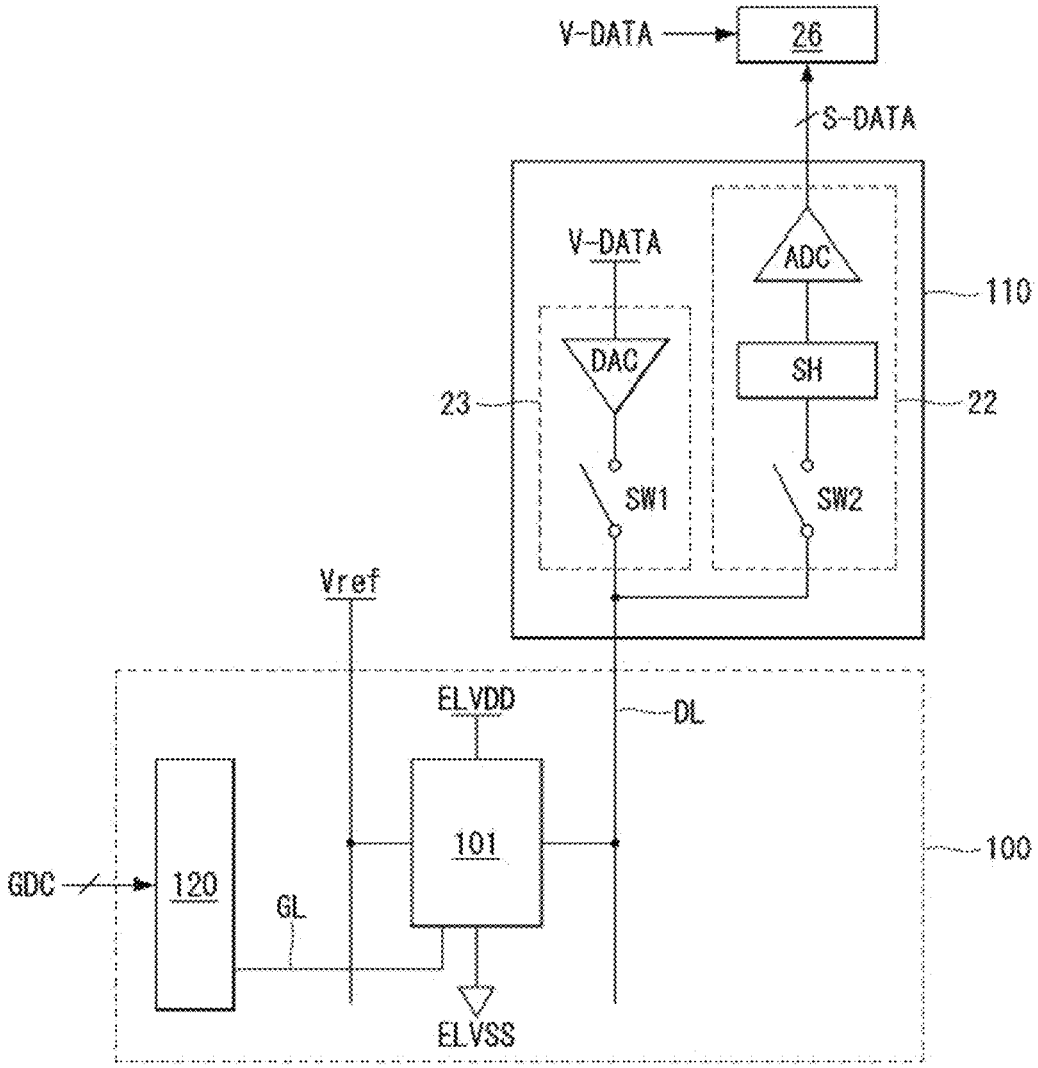
FIG. 2 is a schematic view of an external compensation circuit according to an aspect of the present disclosure.

A display device of the present disclosure may use an external compensation circuit or an internal compensation circuit. FIG. 2 is a schematic view of an external compensation circuit.

Referring to FIG. 2, the data driver 110 comprises a sensing part 22 that are connected to the sensing path, and a data voltage generator 23.

The data voltage generator 23 comprises a DAC and a first switching element SW1. The sensing path comprises a data line DL connected to sub-pixels 101, a second switching element SW2, a sample and hold circuit SH, and an analog-to-digital converter (hereinafter, "ADC").

Direct current voltages such as a pixel driving voltage ELVDD, a low-potential voltage ELVSS, and a reference voltage Vref may be inputted to the sub-pixels 101.

The data voltage generator 23 supplies data voltages outputted from the DAC to the data line DL via output buffers (not shown) and the first switching element SW1 in a data programming step during which the first switching element SW1 is turned on. The data voltages are supplied to the sub-pixels 101 when gate signals synchronized with the data voltages are supplied to the gate line GL.

The sensing part 22 is connected to the sub-pixels 101 through the data line DL. The sensing part 22 senses a voltage or current on a node between the source of the driving element and the light-emitting element. The second switching element SW2 is turned on in a sensing mode to connect the data line DL to the sample and hold circuit SH.

The sample and hold circuit SH accumulates electric charge from the data line DL in an integrator, and samples the output voltage of the integrator and supplies it to the ADC. The ADC converts an input voltage from the sample and hold circuit to digital data, i.e., ADC data S-DATA. The ADC data S-DATA represents digital values of the electrical characteristics of each sub-pixel 101 which may be measured by the current/voltage on the source node of the driving element—for example, the threshold voltage of the driving element, the electron mobility of the driving element, temperature variation of the driving element, and the threshold voltage of the OLED. The sensing part 22 may be implemented as a well-known voltage sensing circuit or current sensing circuit. The ADC data S-DATA outputted from the sensing part 22 is sent to the timing controller 130.

The timing controller 130 compensates for variations in the electrical characteristics of the sub-pixels or variations in the threshold voltage of the driving element over time by selecting a preset compensation value in accordance with the ADC data S-DATA from the sensing part 22, modulating pixel data for the input image by this compensation value, and sending the modulated pixel data to the data driver 110. A logic part of the timing controller 130 may modulate the pixel data V-DATA by selecting a set compensation value from a lookup table according to the sensing result for each sub-pixel and adding the selected compensation value to the input image's video data V-DATA or multiplying video data of the input image (V-DATA) by the selected compensation value.

In the present disclosure, a variation in the electrical characteristics caused by a decrease in the threshold voltage of the driving element or OLED or a decrease in the temperature of the driving element may be compensated for by adding a compensation value (offset) to the pixel data. In the present disclosure, a variation in the electrical characteristics caused by an increase in the threshold voltage of the driving element or OLED or an increase in the temperature of the driving element may be compensated for by subtracting a compensation value (offset) from the pixel data. Moreover, in the present disclosure, a variation in the electrical characteristics caused by a variation in the electron mobility of the driving element may be compensated for by multiplying the pixel data by a compensation value (gain).

The lookup table receives the ADC data S-DATA and the input image's pixel data V-DAT by a memory address, and outputs the compensation values stored in the address. The compensation values preset in the lookup table may include one or more among a compensation value for the threshold voltage of the driving element, a compensation value for the threshold voltage of the OLED, a compensation value for temperature variation of the driving element, a compensation value for the electron mobility of the driving element, etc. The pixel data V-DATA modulated by a compensator 26 is sent to the data voltage generator 23. The modulated pixel data V-DATA is converted to pixel data voltages by the data voltage generator 23 and sent to the data line DL.

In a manufacturing process of the display panel 100, a thermal deposition process is repeated for each material of an organic compound layer as a substrate moves between process chambers, in order to form the organic compound layer on the pixels. However, this thermal deposition process increases the manufacturing costs and the equipment investment spending due to the waste of materials.

The organic compound layer may be formed on the pixels by a solution process such as inkjet printing or nozzle coating. The solution process can reduce the waste of materials and the equipment investment spending since materials in solution state are injected onto desired positions on the substrate through nozzles of an injector, as shown in FIG. 3.

Figure 3:
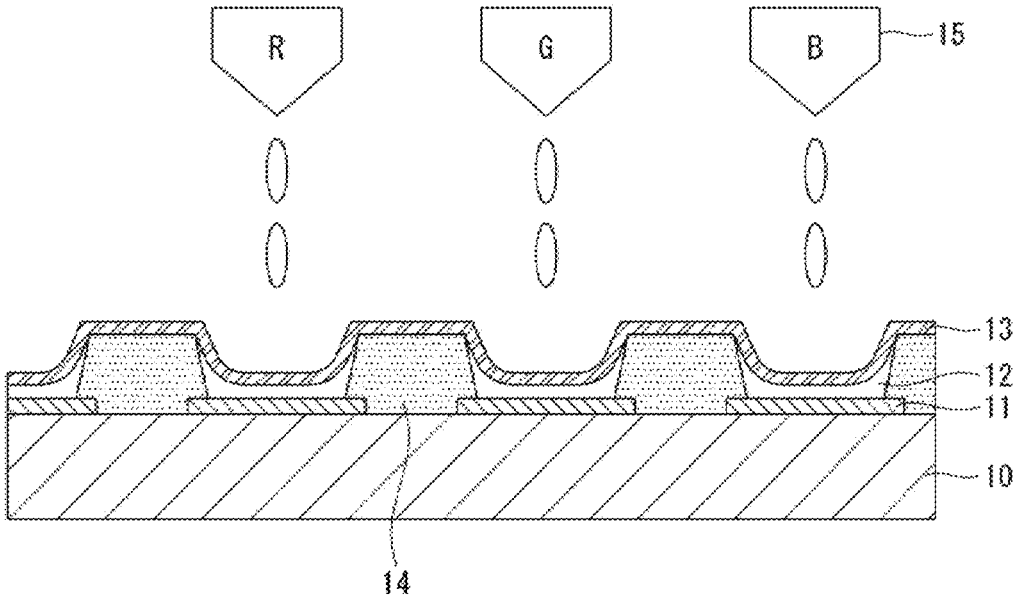
FIG. 3 is a cross-sectional view of a display panel which schematically depicts a solution process.

Referring to FIG. 3, a sub-pixel area is defined on a substrate 10 of the display panel 100. A pattern of first electrodes 11 of the OLEDs of the sub-pixels is formed on the substrate 10.

A bank pattern 14 is formed at the boundary between each sub-pixel. The bank pattern 14 defines a light-emitting area in each sub-pixel. In a light-emitting area with no bank pattern 14, the first electrode 11 may be exposed, and an organic compound layer 12 of the OLED may be formed thereon by a solution process. The nozzles 15 of the injector are aligned on the sub-pixels of red (R), green (G), and blue (B) to allow an organic compound solution to be dropped into the sub-pixel areas. The bank pattern 14 may be formed of a hydrophobic organic insulating material.

Figure 4A:
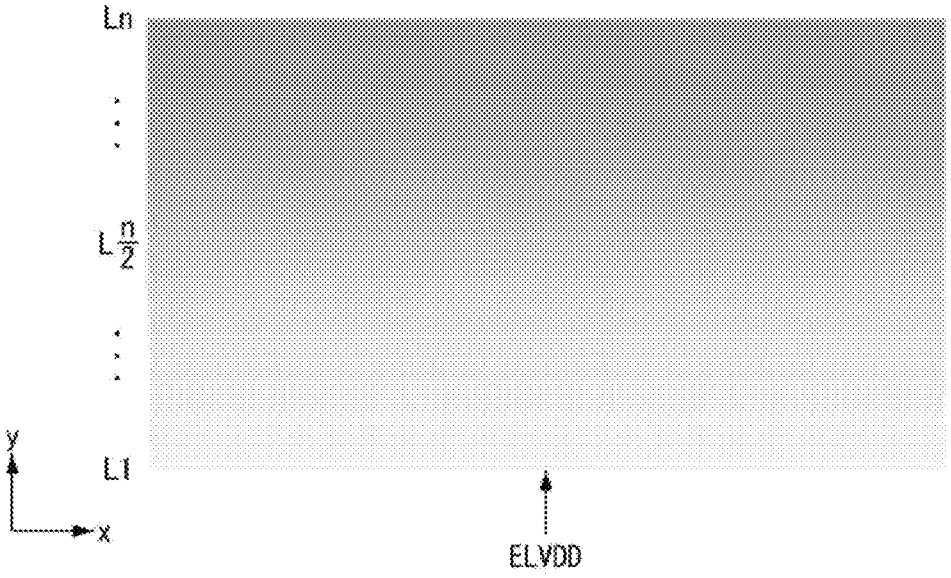
FIGS. 4A to 4C are views showing luminance non-uniformity on a screen.

The luminance of the display panel 100 may become non-uniform due to various causes. For example, when a pixel driving voltage ELVDD and a low-potential voltage ELVSS are supplied to the sub-pixels 100 as shown in FIG. 2, the amount of voltage drop in ELVDD increases as the distance from a power input node to which ELVDD is applied increase, because of an IR drop. The larger the amount of current in the OLEDs of the sub-pixels, the higher the peak luminance and the larger the variation in ELVDD on the screen. As the variation in ELVDD—that is, the rate of change (or slope) in ELVDD—increases with respect to the position on the screen, the luminance of the pixels deteriorates with increasing distance from the power input node as shown in FIG. 4A, even when pixel data of the same white level is written to all the pixels on the screen. As shown in FIG. 4A, the luminance decreases toward the nth pixel line Ln since the power input node is located close to the first pixel line L1.

In a case where the organic compound layer of the sub-pixels is formed by a solution process, the pixels may consist only of red, green, and blue sub-pixels, without white sub-pixels. In this case, when pixel data of a peak white level is written to the pixels, the maximum amount of current flows in the OLEDs of the red, green, and blue sub-pixels. This can lead to a severe IR drop and a larger voltage drop in ELVDD, making differences in vertical luminance visible on the screen.

Figure 4B:
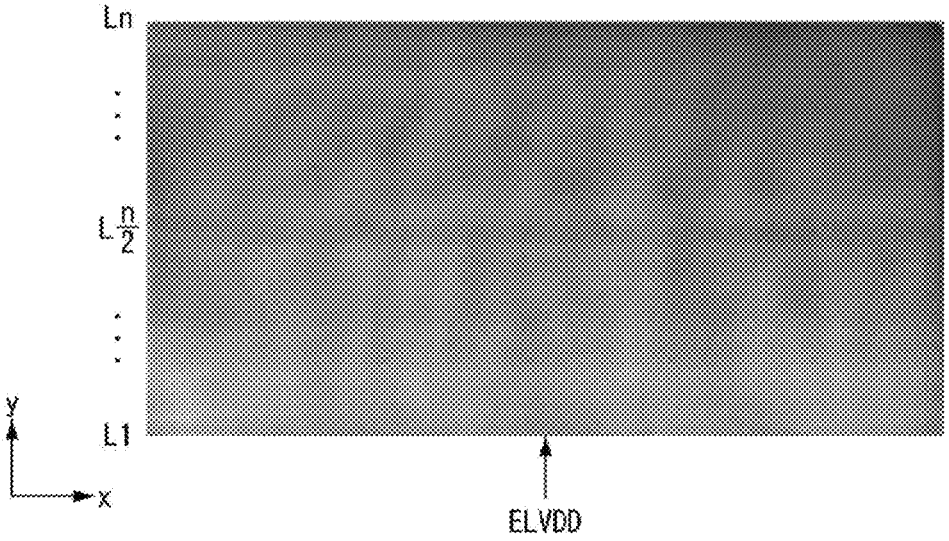
Figure 4C:
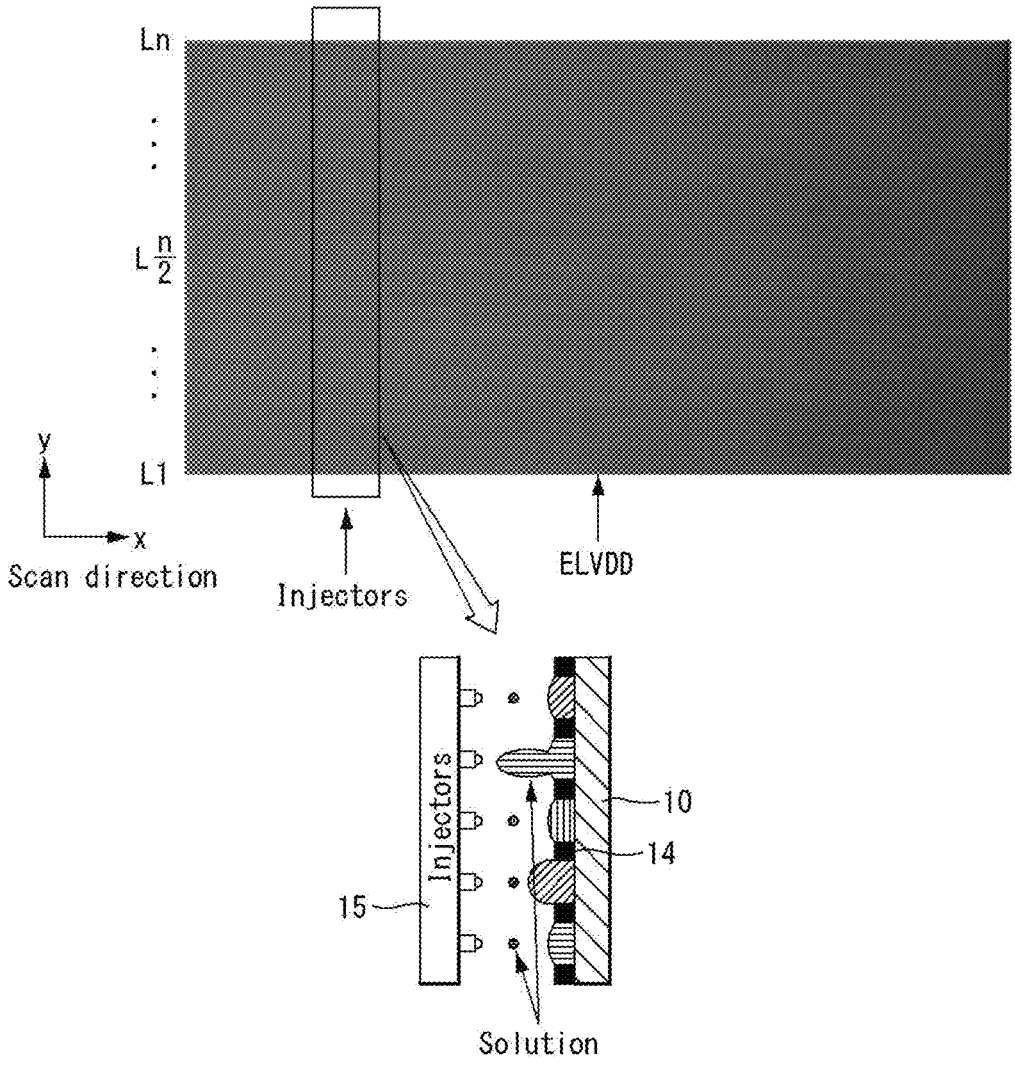

The luminance of the screen may become non-uniform due to differences in thickness, concentration, and efficiency between solutions for each sub-pixel dropped on the substrate in the solution process. FIG. 4B shows an example of luminance non-uniformity caused by variations in efficiency between solutions. This luminance non-uniformity may be represented in different forms for different colors. FIG. 4C shows an example of scan mura which appears when solutions are dropped onto the substrate 10 as injectors arranged in a row are moved along the x axis of the substrate. The luminance non-uniformities shown in FIGS. 4A to 4C may degrade image quality and be the cause of a ghost image.

In the present disclosure, the average luminance of an input image is calculated for every frame so that the peak luminance of sub-pixels is controlled to thereby reduce power consumption and deterioration of the sub-pixels, and the peak luminance is controlled for each position on the screen to enables uniform luminance on the screen. Moreover, in the present disclosure, when a still image remains on the screen for more than a given period of time, the peak luminance may be gradually lowered to reduce deterioration of the sub-pixels.

FIG. 5 is a view showing a luminance controller according to the present disclosure. The luminance controller may be embedded in the timing controller 130, but is not limited thereto.

Referring to FIG. 5, the luminance controller includes an average luminance calculator 202, a peak luminance controller 204, and a luminance adjuster 210.

The average luminance calculator 202 receives pixel data for an input image (RGB) and calculates the average luminance of the input image for each frame. The pixel data for the input image RGB may be de-gamma corrected and inputted into the average luminance calculator 202. The average luminance may be calculated as a well-known average picture level (hereinafter, referred to as "APL"). The APL may be calculated as the average luminance of the brightest color in 1 frame of image data.

An image with a large number of pixel data of a white level has a high average picture level APL. Contrariwise, an image with a small number of pixel data of white level has a low average picture level APL. For 8 bits of pixel data, the peak white level is a grayscale value 255.

Figure 6:
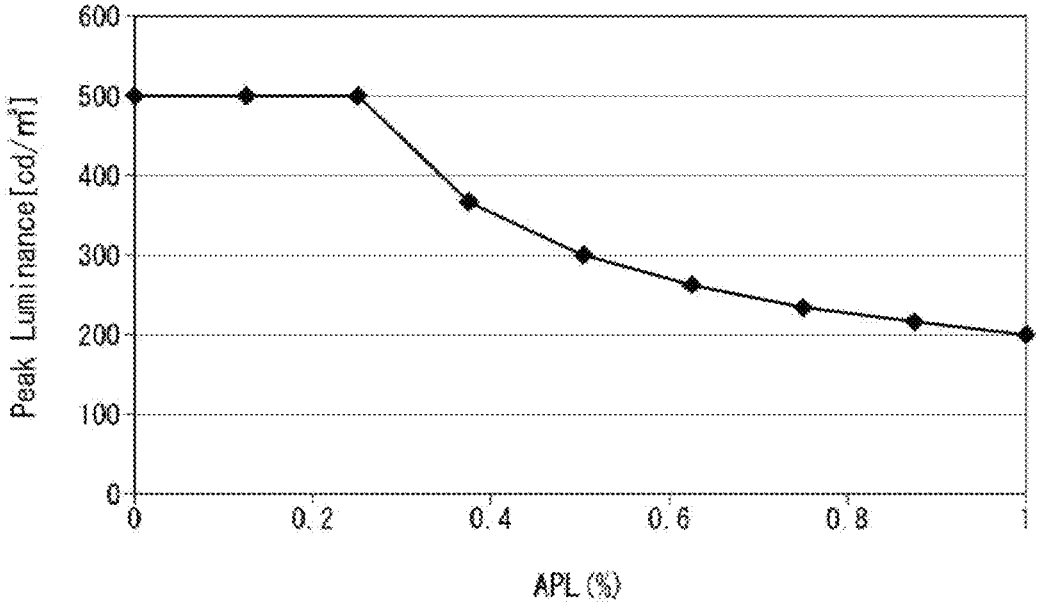
FIG. 6 shows an example of a PLC curve.

The peak luminance controller 204 limits the peak luminance of the screen AA depending on the average luminance of an input image based on a peak luminance control (hereinafter, "PLC") curve. FIG. 6 shows an example of the PLC curve.

The peak luminance controller 204 produces a peak luminance value corresponding to the APL of an input image. In the example of FIG. 6, the peak luminance value is set to 500[cd/m$^2$] in a dark image with an APL of 20% or less, and the peak luminance value is set to 200[cd/m$^2$] in a bright image with an APL of 100%. The peak luminance refers to the highest luminance in each sub-pixel. The peak luminance is limited to the peak luminance values on the APL curve, and the higher the APL, the lower the peak luminance.

Figure 7:
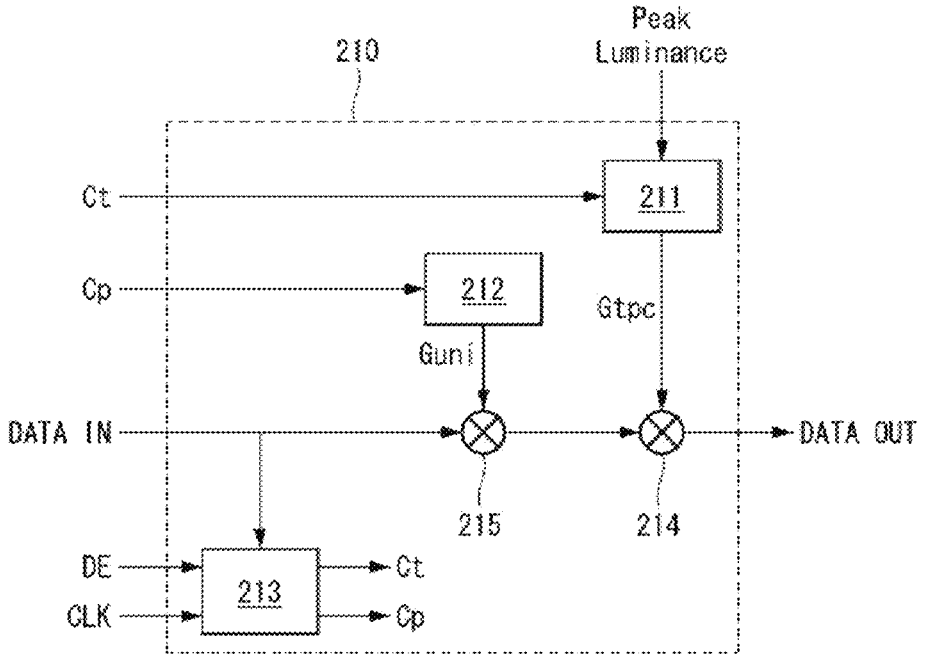
FIG. 7 is a view showing a luminance adjuster according to a first aspect of the present disclosure.

The luminance adjuster 210 analyzes the input image, and, upon receiving a still image for a given period of time, gradually lowers the peak luminance of the screen AA over time while the still image remains. Moreover, the luminance adjuster 210 adjusts the peak luminance for each position on the screen AA so that the peak luminance is uniform across the entire screen AA. To this end, the luminance adjuster 210 may execute a TPC (Temporal Peak Luminance Control) algorithm to gradually lower the peak luminance of the screen AA while a still image is being inputted, as shown in FIG. 7. In the TPC algorithm, the pixel data is down-modulated by a first gain Gtpc while a still image remains, so that the peak luminance values of the sub-pixels 101 are decreased to lower the current of all the sub-pixels 101 on the screen. The first gain Gtpc is a gain value that is set to a value between 0 and 1 and lowers the average luminance of the screen AA. Moreover, the luminance adjuster 210 modulates the pixel data with a second gain Guni set for each position on the screen AA, so as to enable uniform luminance on the screen AA. The second gain Guni may be set to a value between 0 and 1. The first gain Gtpc lowers the luminance of the sub-pixels while a still image remains. The second gain Guni adjusts the peak luminance of sub-pixels such that the peak luminance at other positions than the reference point is equal to the peak luminance of the reference point.

The pixel data outputted from the luminance adjuster 210 is gamma-corrected and modulated by an external compensation circuit and sent to the data driver 110.

The luminance adjuster 210 may adjust the luminance to be uniform across the entire screen by using one or more of the following: IR drop variation compensation, efficiency variation compensation, and scan mura compensation, in order to compensate for the luminance non-uniformity in one or more of FIGS. 4A to 4C. The luminance adjuster 210 may set TPC gains for each position and each color when the TPC is activated, so that peak luminance adjustment can be done in tandem with the TPC.

In the IR drop variation compensation method, the luminance non-uniformity shown in FIG. 4A caused by an IR drop is compensated for. In the IR drop variation compensation method, the peak luminance may be compensted to be uniform on the entire screen by using a gain an IR drop variation with respect to a reference point. The reference point may be a first pixel line L1 with no IR drop or a pixel line at the center of the screen AA. The gain for a pixel line to which an ELVDD lower than the ELVDD applied to the reference point is applied may be set higher than the gain for the reference point. In contrast, the gain for a pixel line to which an ELVDD higher than the ELVDD applied to the reference point may be set lower than the gain for the reference point.

As the IR drop is proportional to the amount of current, it may be desirable to compensate for variation in IR drop by reflecting a current decrease caused by a decrease in peak luminance into a compensation map for each position when the TPC algorithm is executed. The TPC is a peak luminance control method that gradually lowers the peak luminance on all the sub-pixels on the screen AA while a still image remains, so as to prevent degradation of the pixels and improve image quality and lifespan.

In the efficiency variation compensation method, the luminance non-uniformity shown in FIG. 4B caused by differences in efficiency between OLEDs of different colors is compensated for. In an efficiency variation compensation map, the luminance of the screen may be adjusted to be uniform by using a gain having a value to invert an efficiency variation in each color with respect to a reference point. The reference point may be the luminance of the pixels at the center of the screen or the average luminance of the screen. An irregular luminance non-uniformity shown in FIG. 4B may appear in other forms for different colors of the sub-pixels. Thus, the gain applied to the efficiency variation compensation method may be set individually for each color and position of the sub-pixels. The gain applied to a pixel line with a lower peak luminance than the peak luminance of the reference point may be set higher than the gain for the reference point. In contrast, the gain applied to a pixel line with a higher peak luminance than the peak luminance of the reference point may be set lower than the gain for the reference point.

In the scan mura compensation method, the luminance non-uniformity shown in FIG. 4C, orthogonal to the scan direction of the injector, is compensated for. In a scan mura compensation map, the luminance of the screen may be adjusted to be uniform by using a gain having a value to invert a scan mura with respect to a reference point. The reference point may be the luminance of the pixels at the center of the screen or the average luminance of the screen. A scan mura shown in FIG. 4C may appear in other forms for different colors of the sub-pixels. Thus, the gain applied to the scan mura compensation method may be set individually for each color and position of the sub-pixels. The gain applied to sub-pixels with a lower peak luminance than the peak luminance of the reference point may be set higher than the gain for the reference point. In contrast, the gain applied to sub-pixels with a higher peak luminance than the peak luminance of the reference point may be set lower than the gain for the reference point.

Referring to FIG. 7, the luminance adjuster 210 comprises a first luminance adjuster 211, a second luminance adjuster 212, an image analyzing unit 213, a first gain applier 214, and a second gain applier 215.

The image analyzing unit 213 determines whether pixel data inputted to the current frame is still image data or not, based on the result of a comparison between frames of an input image's pixel data or the result of a motion vector calculation. The image analyzing unit 213 samples bits of the input image's pixel data by using a clock CLK.

A timing signal synchronized with the pixel data may be a data enable signal DE or a horizontal synchronization signal Hsync. One cycle of the data enable signal DE or horizontal synchronization signal Hsync is 1 horizontal period. The clock CLK is generated at a much higher frequency than the timing signal. The image analyzing unit 213 may count data enable signals DE by clocks CLK and detect the time and position on the screen where the pixel data is written based on the count value. When a still image starts to appear, the image analyzing unit 213 may reset the count value and count the duration of the still image to generate time data Ct and positional data Cp indicating a pixel line and its sub-pixels to which the pixel data is written.

The first luminance adjuster 211 receives the time data Ct and an input peak luminance value from the peak luminance controller 204. When a still image is inputted, the first luminance adjuster 211 executes the TPC algorithm to gradually adjust down the peak luminance over time based on the TPC curve shown in FIG. 8.

Figure 8:
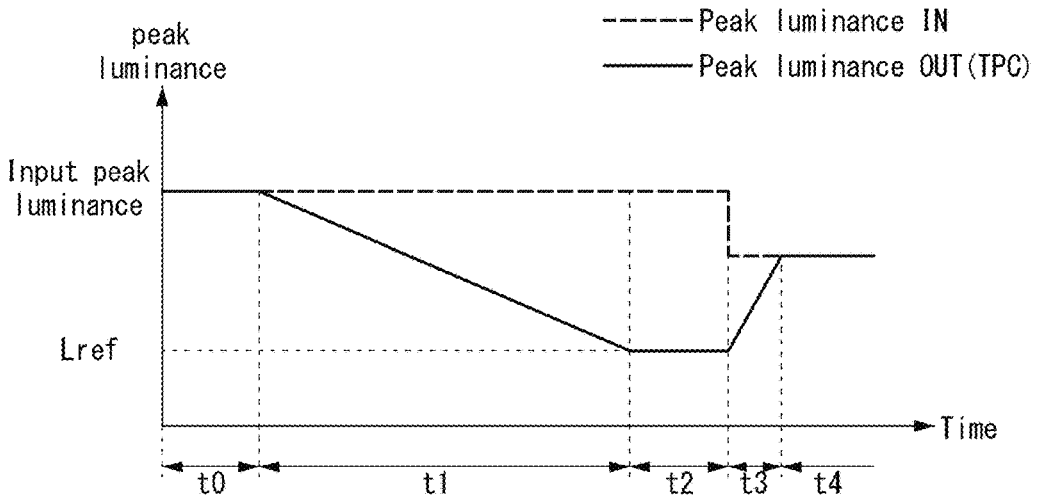
FIG. 8 is a view showing an example of a TPC curve.

As shown in FIG. 8, the TPC curve may be divided into five periods. The first period t0 is a standby time that lasts for a certain amount of time from the start of a still image input. The first luminance adjuster 211 applies the input peak luminance value without adjustment. Thus, the peak luminance Lpeak of the sub-pixels 101 is equal to the peak luminance defined on the PLC curve during the first period t0. The first period t0 may be set to approximately 1 minute, but not limited thereto.

The second period t1 is an attenuation period in which, when a still image is inputted after the first period T0, a first gain Gtpc of less than 1 is generated to lower the peak luminance. Once the peak luminance of the sub-pixels is lowered, the pixel data values are decreased. This leads to a decrease in the current flowing through the OLEDs of the sub-pixels, thereby reducing the ELVDD variation on the screen. The first gain Gtpc is a value for decreasing the peak luminance of the screen. The first luminance adjuster 211 gradually raises the first gain Gtpc to a value close to 1 within the second period t1 so that the peak luminance decreases at a slow rate.

The first luminance adjuster 211 generates a first gain Gtpc of less than 1 during the second period t1, and raises the gain Gtpc to 1 or a value close to 1 so that the peak luminance of the sub-pixels is lowered to a given reference luminance Lref. Through a test, the reference luminance Lref is set to the minimum peak luminance at which there is no image quality degradation and the luminance perceived by the user does not change rapidly. The second period t1 may be set to approximately 4 to 5 minutes, but not limited thereto.

The third period t2 is a transition time during which the reference luminance Lref is maintained when the still image ends as the scene of the input image is changed after the second period t1. The first luminance adjuster 211 maintains the peak luminance at the reference luminance Lref during the third period t2.

The fourth period t3 is a luminance rise time during which the peak luminance is restored to the input peak luminance value, and the fifth period t4 is a time during which the peak luminance is maintained at the input peak luminance value.

The first gain applier 214 gradually lowers the peak luminance of each sub-pixel while the still image remains by multiplying the pixel data DATA IN with the first gain Gtpc by using a multiplier.

The second luminance adjuster 212 receives positional data Cp. The second luminance adjuster 212 adjusts the peak luminance of the sub-pixels to be equal to the peak luminance of center of the screen AA or the position AA where the ELVDD voltage drop is largest. To this end, the second luminance adjuster 212 adjusts the peak luminance to be equal to the peak luminance of sub-pixels on the entire screen by setting the second gain Guni for a preset reference pixel line or reference sub-pixel to 1 and setting the second gain Guni for other pixel lines and sub-pixels to a value less than 1 and greater than 0. The second gain Guni is set in the form of a compensation map in which it is mapped to a position on the screen AA. The second gain applier 215 multiplies the pixel data DATA IN by the second gain Guni by using a multiplier. With pixel data DATA OUT modulated through the first and second gain appliers 214 and 215, the peak luminance is adjusted to be uniform across the entire screen, when the peak luminance of each sub-pixel is gradually lowered while the still image remains.

Figure 9:
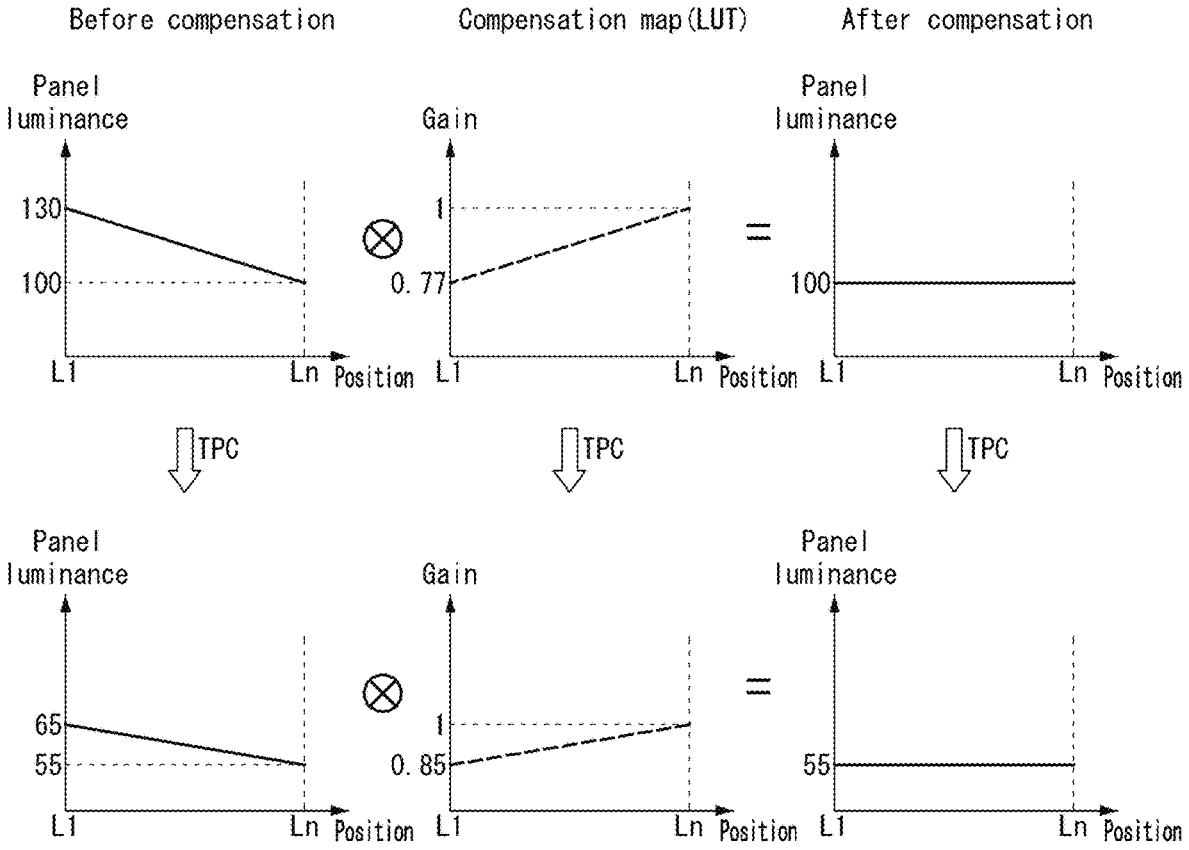
FIG. 9 is a view showing the peak luminance over time before and after compensation.
Figure 10:
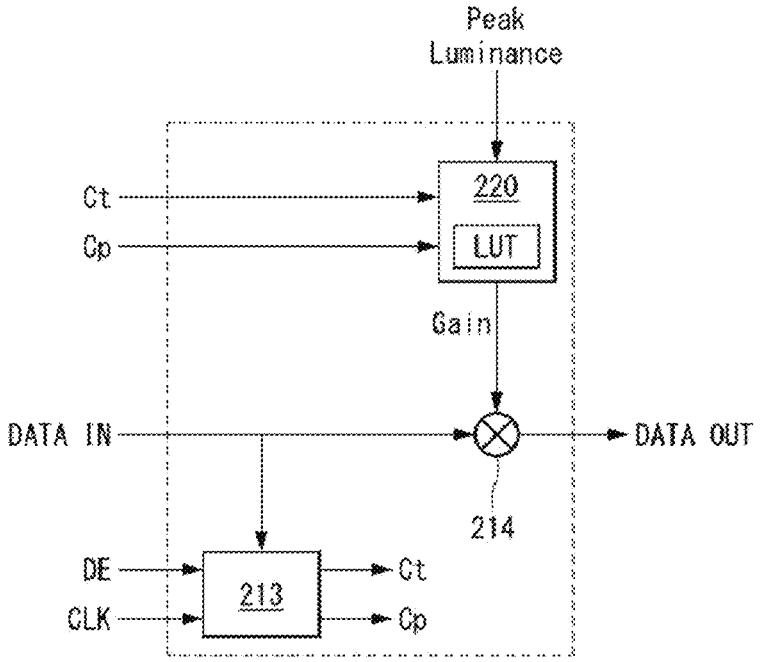
FIG. 10 is a view showing an example in which gains are integrated into one by the luminance adjuster shown in FIG. 7.

As shown in FIG. 9, the first and second gains Gtpc and Guni may be integrated into one gain and implemented in a look-up table. In other words, if the first gain Gtpc is set to a different value for each position on the screen so that the peak luminance is equal to the peak luminance of sub-pixels on the entire screen, the first gain Gtpc and the second gain Guni do not need to be separate. In this case, as shown in FIG. 10, only one luminance adjuster 211 or 212 and only one gain adjuster 214 or 215 are enough.

FIG. 9 is a view showing the peak luminance over time before and after compensation. In FIG. 9, the term "panel luminance" is the peak luminance of the screen AA.

Referring to FIG. 9, the upper portion shows the peak luminance of the screen before compensation, the gain, and the peak luminance of the screen after compensation, at a first point in time at which a still image starts to be inputted. The TPC algorithm is activated at the first point in time, and gradually lowers the peak luminance of the screen, as shown in FIG. 8. Once the peak luminance of the sub-pixels is lowered, the current flowing through the OLEDs of all the sub-pixels on the screen is decreased, thereby reducing the ELVDD variation on the screen.

In FIG. 9, the lower portion shows the peak luminance of the screen before compensation, the gain, and the peak luminance of the screen after compensation, at a second point in time, after a certain amount of time from the first point in time.

As for the peak luminance of the screen before compensation at the first point in time, the peak luminance of the first pixel line L1 is 130 nits, and the peak luminance of the nth pixel line Ln is 100 nits due to an IR drop in ELVDD, as in the left upper portion of the graph. The nth pixel line Ln with a relatively lower peak luminance may be set as a reference point for compensation. The nth pixel line Ln may be a pixel line that has the lowest peak luminance on the screen or a pixel line (or sub-pixel) at the center of the screen. In this case, the peak luminance of the screen before compensation is not constant and decreases as it goes from the first pixel line L1 toward the nth pixel line Ln.

In a compensation map for compensating for luminance non-uniformity on the screen at the first point in time, different gain values are individually set for different positions on the screen. The gain values in the compensation map are set to have a reverse slope of the peak luminance of the screen before compensation. The gain value for the reference point may be set to 1. In contrast, the gain value for the first pixel line L1 may be set to 0.77, so that the first pixel line L1 and the nth pixel line Ln have the same peak luminance. When the pixel data to be written to each sub-pixel is multiplied by such a gain Gain and the modulated pixel data is written to the sub-pixels 101, the peak luminance of the screen is constant, i.e., 100 nits, across the screen as shown in the upper right portion of the graph.

The peak luminance of the screen is lowered at the second point in time by the TPC algorithm. As for the peak luminance of the screen before compensation at the second point in time, the peak luminance of the first pixel line L1 is lowered to 65 nits, and the peak luminance of the nth pixel line Ln is lowered to 55 nits, as in the left lower portion of the graph. The nth pixel line Ln is set as a reference point for compensation. The peak luminance of the screen before compensation still is not constant and decreases as it goes from the first pixel line L1 toward the nth pixel line Ln.

In a compensation map for compensating for luminance non-uniformity on the screen at the second point in time, the gain values are set to have a reverse slope of the peak luminance of the screen before compensation. The gain value for the reference point may be set to 1. In contrast, the gain value for the first pixel line L1 may be set to 0.85, which is a higher value, so that the first pixel line L1 and the nth pixel line Ln have the same peak luminance. When the pixel data to be written to each sub-pixel is multiplied by such a gain Gain and the modulated pixel data is written to the sub-pixels 101, the peak luminance of the screen is constant, i.e., 55 nits, across the screen as shown in the lower right portion of the graph.

Referring to FIG. 10, an integrated luminance adjuster 220 may load time data Ct and positional data Cp into a look-up table with the gains Gain set as shown in FIG. 9. The time data Ct and the positional data Cp indicate an address in the look-up table. Accordingly, the look-up table outputs the gain Gain stored in the address indicated by the time data Ct and the positional data Cp. The gain applier 214 modulates the pixel data by multiplying the pixel data by the gain Gain from the integrated luminance adjuster 220.

Figure 11A:
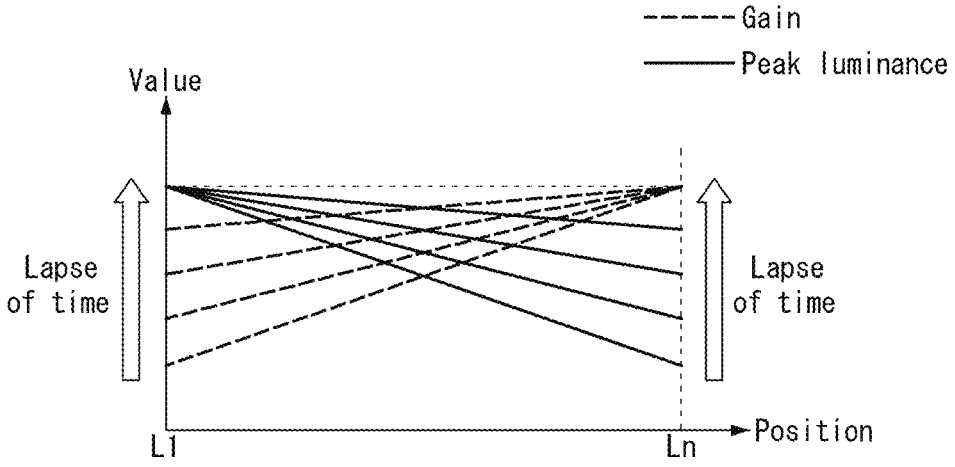
FIGS. 11A and 11B are views of the peak luminance compensation method of FIG. 10 in which the peak luminance is normalized with respect to a first pixel line and an nth pixel line, respectively.
Figure 11B:
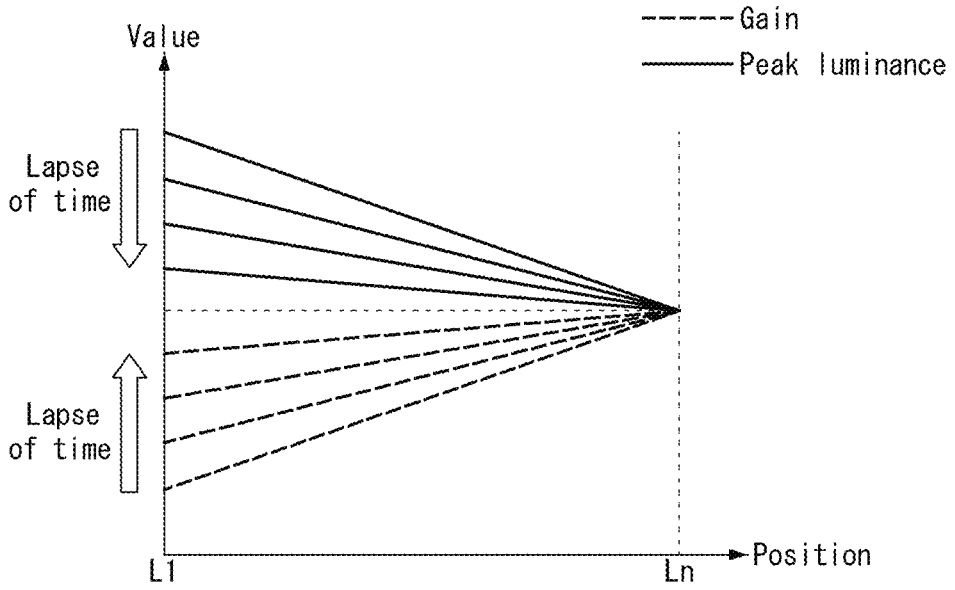

FIGS. 11A and 11B are views of the peak luminance compensation method of FIG. 10 in which the peak luminance is normalized with respect to a first pixel line and an nth pixel line, respectively.

Referring to FIG. 11A, the absolute value of the gain rises over time while the TPC algorithm is executed. When the peak luminance of the screen is normalized with respect to the first pixel line L1 before the TPC algorithm is applied, the peak luminance of the nth pixel line Ln rises over time.

Referring to FIG. 11B, when the peak luminance of the screen is normalized with respect to the nth pixel line Ln before the TPC algorithm is applied, the peak luminance of the first pixel line L1 decreases over time.

Figure 12:
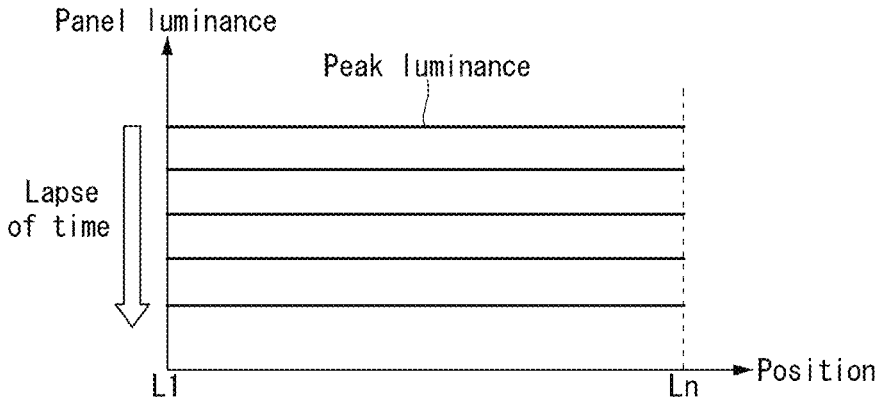
FIG. 12 is a view showing the peak luminance of the screen after compensation using TPC.

After the TPC algorithm is executed for compensation, the peak luminance of the screen after compensation is uniform across the entire screen and decreases steadily over time, as shown in FIG. 12.

Figure 13:
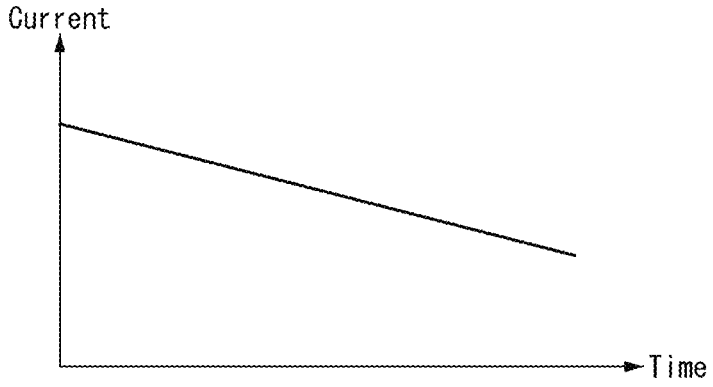
FIG. 13 is a view showing a change in the current in the OLED caused by application of the TPC algorithm.

FIG. 13 is a view showing the change in the current in the OLED caused by application of the TPC algorithm. As shown in FIG. 13, the TPC algorithm gradually lowers the peak luminance of each sub-pixel while a still image is being inputted. By modulating pixel data with a gain defining the peak luminance, the amount of current flowing from ELVDD to the OLED in each sub-pixel decreases over time as shown in FIG. 13.

Figure 14:
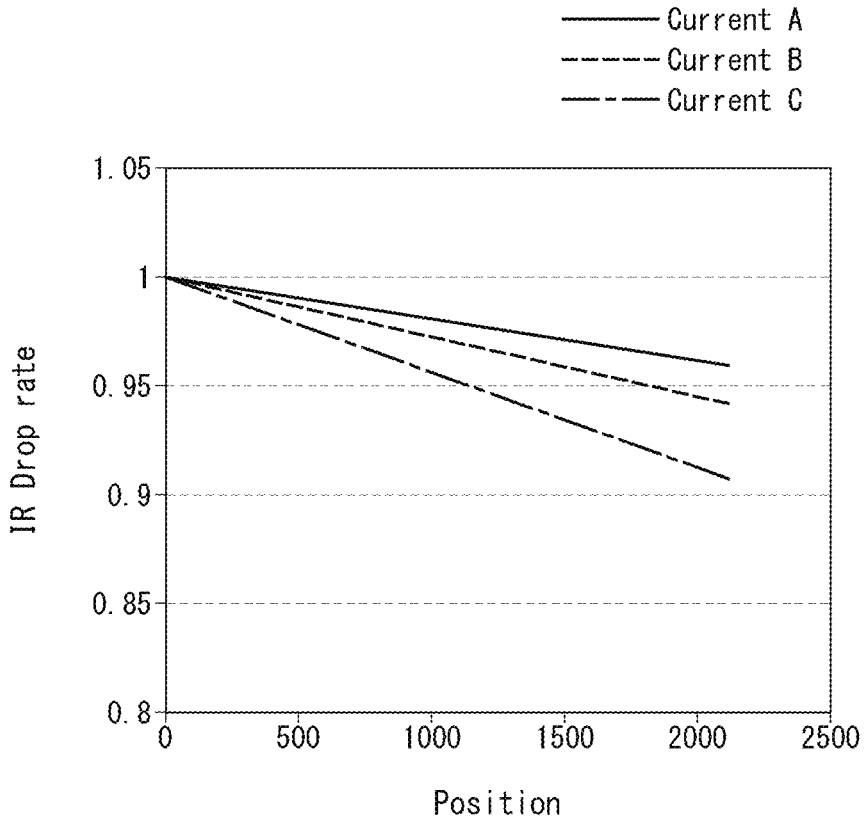
FIG. 14 is a view showing changes in the rate of IR drop with respect to current.
Figure 15:
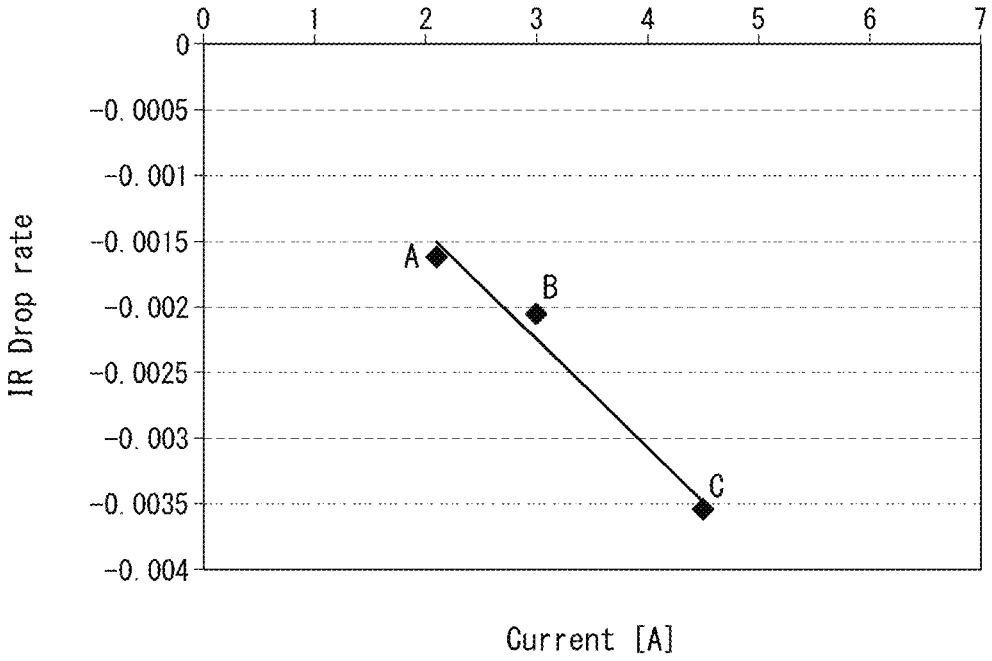
FIG. 15 is a view showing changes in the slope of IR drop rate with respect to current.

The variation in ELVDD voltage drop on the screen caused by an IR drop decreases with decreasing current. For example, when Current A<Current B<Current C, the ELVDD variation (amount of change) on the screen is the largest because the slope of IR drop is steepest for Current A. FIG. 14 is a view of the measurements shown in FIG. 13 reconstructed into the slope of IR drop rate with respect to current strength A, B, and C. As can be seen from the test results of FIGS. 14 and 15, IR drop is proportional to current strength, so it is desirable to reflect changes in the strength of Currents A, B, and C to a gain for compensating for luminance non-uniformity. For example, the gain Gain applied to a certain pixel position on the screen may be set to different values for Currents A, B, and C. When the current strength is high, the slope of IR drop rate is steep. Therefore, the gain Gain may be set to a lower value than when the current strength is low.

Figure 16:
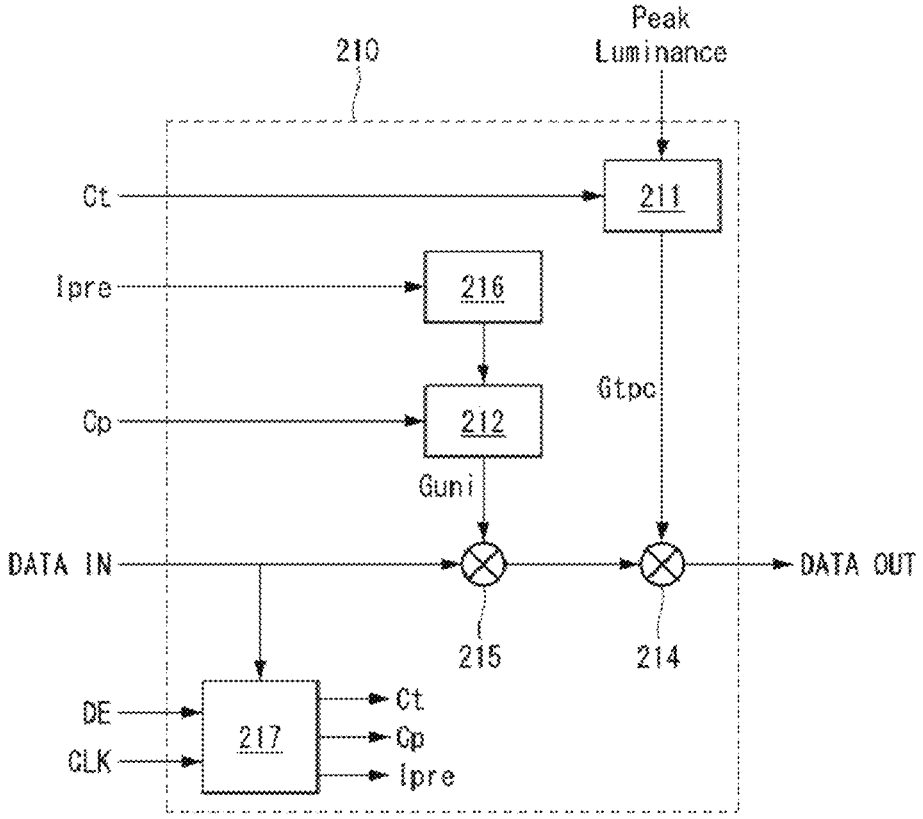
FIG. 16 is a view showing in detail a luminance adjuster according to a second aspect of the present disclosure.
Figures 17, 18:
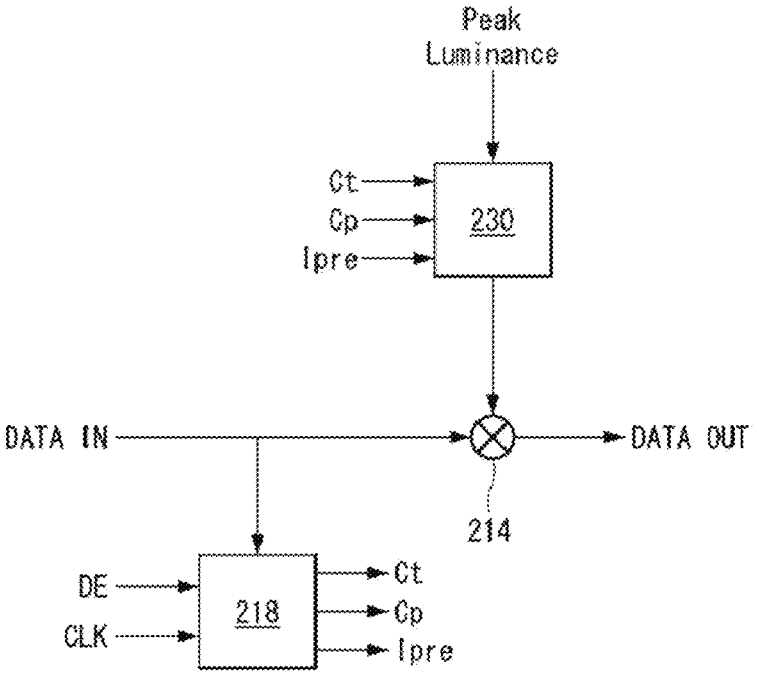
FIG. 17 is a view showing an example in which gains are integrated into one by the luminance adjuster shown in FIG. 16.
FIG. 18 shows the results of a simulation showing the luminance uniformity effects before and after peak luminance compensation according to the present disclosure.

FIG. 16 is a view showing in detail a luminance adjuster according to a second aspect of the present disclosure. FIG. 17 is a view showing an example in which gains are integrated into one by the luminance adjuster shown in FIG. 16.

Referring to FIG. 16, the luminance adjuster 210 comprises a first luminance adjuster 211, a second luminance adjuster 212, an image analyzing unit 217, a current predictor 216, a first gain applier 214, and a second gain applier 215.

The image analyzing unit 217 determines whether pixel data inputted to the current frame is still image data or not, based on the result of a comparison between frames of an input image's pixel data or the result of a motion vector calculation. The image analyzing unit 217 samples bits of the input image's pixel data by using a clock CLK.

The image analyzing unit 217 may count data enable signals DE by clocks CLK and detect the time and position on the screen where the pixel data is written based on the count value. When a still image starts to appear, the image analyzing unit 217 may reset the count value and count the duration of the still image to generate time data Ct and positional data Cp indicating a pixel line and its sub-pixels to which the pixel data is written.

The image analyzing unit 217 determines the amount of current obtained through a test based on pixel data values by using a preset data-current table. The image analyzing unit 217 predicts the amount of current required for each sub-pixel based on the pixel data and predicts the amount of current for 1 frame based on the total amount of current in all sub-pixels. Therefore, the image analyzing unit 217 outputs a predicted current value Ipre for each frame period.

The current predictor 216 sends the predicted current value Ipre to the second luminance adjuster 212.

The first luminance adjuster 211 receives the time data Ct and an input peak luminance value from the peak luminance controller 204. When a still image is inputted, the first luminance adjuster 211 executes the TPC algorithm to gradually adjust down the peak luminance over time based on the TPC curve shown in FIG. 8.

The first gain applier 214 gradually lowers the peak luminance of each sub-pixel while the still image remains by multiplying the pixel data DATA IN by the first gain Gtpc by using a multiplier.

The second luminance adjuster 212 receives the predicted current value Ipre and positional data Cp. The second luminance adjuster 212 selects a second gain Guni for the predicted current value Ipre, which is individually set for each position on the screen AA. The second gain Guni may be set to 1 for a reference point, and may be set to a value less than 1 for other pixel lines and sub-pixels. The second gain Guni is set to different values for different current strengths A, B, and C. The second gain applier 215 multiplies the pixel data DATA IN by the second gain Guni by using a multiplier. With pixel data DATA OUT modulated through the first and second gain appliers 214 and 215, the peak luminance is adjusted to be uniform across the entire screen, when the peak luminance of each sub-pixel is gradually lowered while the still image remains.

As shown in FIG. 9, the first and second gains Gtpc and Guni may be integrated into one gain and implemented in a look-up table. In other words, if the first gain Gtpc is set to a different value for each position on the screen so that the peak luminance is equal to the peak luminance of sub-pixels on the entire screen, the first gain Gtpc and the second gain Guni does not need to be separate. In this case, as shown in FIG. 17, only one luminance adjuster 211 or 212 and only one gain adjuster 214 or 215 are enough.

Referring to FIG. 17, an integrated luminance adjuster 230 may load time data Ct, positional data Cp, and a predicted current value Ipre into a look-up table with the gains Gain set as shown in FIG. 9. The time data Ct, the positional data Cp, and the predicted current value Ipre indicate an address in the look-up table. Accordingly, the look-up table outputs the gain Gain stored in the address indicated by the time data Ct, positional data Cp, and predicted current value Ipre. The gain applier 214 modulates the pixel data by multiplying the pixel data by the gain Gain from the integrated luminance adjuster 230.

FIG. 18 shows the results of a simulation showing the luminance uniformity effects before and after peak luminance compensation according to an aspect of the present disclosure. In FIG. 18, "before TPC" shows the peak luminance measured on the screen before samples are compensated for, and "after TPC" shows the peak luminance measured on the screen after the samples are compensated for using the peak luminance compensation method of FIG. 9.

Referring to FIG. 18, in a simulation where the peak luminance of a sample whose ratio of maximum and minimum figures of peak luminance was 117.7% was compensated for depending on the position on the screen by using the peak luminance control method of the present disclosure, the ratio of maximum and minimum figures of peak luminance was improved to 106.9%. Accordingly, the present disclosure may lower the amount of current in each sub-pixel by gradually lowering the peak luminance while a still image is being inputted, within a range where the viewer cannot sense any degradation in image quality, thereby reducing deterioration of the sub-pixels and improving lifespan. Furthermore, the present disclosure may improve image quality by adjusting the peak luminance to be uniform in every pixel on the screen by using an individual gain for each position while a still image remains.

As described above, the present disclosure reduces the deterioration of sub-pixels and improves the lifetime by gradually lowering the peak luminance within a range in which the viewer does not feel a drop in image quality while the still image is input to the display device.

The present disclosure improves the image quality by uniformly controlling the peak luminance in all the pixels of the screen by using the gain set individually for each position while the still image is displayed on the screen of the display panel.

A display device and a method for controlling the luminance thereof according to various aspects of the disclosure may be described as follows.

A display device comprises: a display panel having a screen where an input image is displayed; a controller configured to generate a gain for decreasing a peak luminance of the input image if the input image is a still image and modulate a pixel data of the input image by the gain; and a display panel drive circuit configured to write the pixel data received from the controller to sub-pixels on the screen. The gain is set to a different value for each position on the screen.

Each of the sub-pixels comprises a light-emitting element. The light-emitting element emits light by a current from a pixel driving voltage supplied to the sub-pixels, and the current in the light-emitting element of each sub-pixel decreases while the still image remains.

The gain is set to 1 for a preset reference point on the screen, and the gain is set to a value of less than 1 at a position where the peak luminance is lower than at the reference point.

The pixel data to be written to each sub-pixel is multiplied by the gain.

The peak luminance and current are gradually lowered in all sub-pixels on the screen while the still image remains.

The absolute value of the gain gradually rises over time at other positions than the reference point while the still image remains.

The controller comprises: an average luminance calculator configured to calculate an average luminance of the input image for each frame; a peak luminance controller configured to output a preset peak luminance value corresponding to the average luminance; a luminance adjuster configured to output the gain while the still image remains, if the input image is a still image; and a gain applier configured to modulate the pixel data of by the gain.

The gain comprises: a first gain for decreasing the luminance of the entire screen while the still image remains; and a second gain for adjusting the peak luminance with respect to the preset reference point on the screen such that the peak luminance of sub-pixel at other positions than the reference point is equal to the peak luminance of sub-pixel at the reference point.

The controller calculates the amount of current required for the display panel for every frame period based on the pixel data, and selects the gain for the current value.

A method for controlling the luminance of a display device, the method comprises: determining whether an input image is a still image; and lowering a peak luminance of sub-pixels on the screen of a display device, while the still image is being inputted, by modulating a pixel data of the input image with a gain set to a different value for each position on the screen.

The peak luminance is gradually lowered in the sub-pixels on the screen while the still image remains.

The absolute value of the gain gradually rises over time at other positions than a preset reference point on the screen while the still image remains.

The method of claim further comprises: calculating the amount of current required for the display panel for every frame period based on the pixel data; and selecting the gain for the current value.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel where an input image including a moving image and a still image is displayed;

a controller configured to generate a gain for decreasing a peak luminance of the still image and modulate a pixel data of the still image by the gain; and a display panel drive circuit configured to write the pixel data received from the controller to sub-pixels of the display panel, wherein the gain is set to be a different value on a different position on the display panel, wherein the gain is set to 1 for a preset reference point on the display panel, and the gain is set to a value of less than 1 at a position where the peak luminance is lower than the reference point, wherein the peak luminance is gradually lowered in the sub-pixels while the still image is displayed, and wherein the gain has an absolute value that is gradually increases over time at positions other than the reference point while the still image is displayed.

2. The display device of claim 1, wherein each of the sub-pixels includes a light-emitting element, and wherein the light-emitting element emits light by a current from a pixel driving voltage supplied to the sub-pixels, and the current in the light-emitting element of each sub-pixel decreases while the still image is displayed, wherein the current is gradually lowered in the sub-pixels while the still image is displayed.

3. The display device of claim 1, wherein the pixel data to be written to each sub-pixel is multiplied by the gain.

4. The display device of claim 1, wherein the controller comprises:

an average luminance calculator configured to calculate an average luminance of the input image for each frame;

a peak luminance controller configured to output a preset peak luminance value corresponding to the average luminance;

a luminance adjuster configured to output the gain while the still image is displayed; and a gain applier configured to modulate the pixel data of by the gain.

5. The display device of claim 4, wherein the gain further comprises:

a first gain for decreasing the luminance of an entire display area of the display panel while the still image is displayed; and a second gain for adjusting the peak luminance with respect to the reference point on the display panel such that the peak luminance of sub-pixel at positions other than the reference point is equal to the peak luminance of sub-pixel at the reference point.

6. The display device of claim 1, wherein the controller calculates an amount of current required for the display panel for every frame period based on the pixel data, and selects the gain for the current.

7. A method for controlling luminance of a display device, the method comprising:

determining whether an input image is a still image; and lowering a peak luminance of sub-pixels on a display panel of a display device, while data for the still image is inputted, by modulating a pixel data of the input image with a gain set to a different value for a different position on the display panel, wherein the gain has an absolute value that is gradually increases over time at positions other than a preset reference point while the still image is displayed.

8. The method of claim 7, wherein the peak luminance are gradually lowered in the sub-pixels on the display panel while the still image is displayed.

9. The method of claim 7, further comprising:

calculating an amount of current required for the display panel for every frame period based on the pixel data; and selecting the gain for the current.

10. A display device comprising:

a display panel where an input image including a moving image and a still image is displayed;

a controller configured to calculate an amount of current required for the display panel for every frame period based on a pixel data of the input image to select a gain for decreasing a peak luminance of the still image, and modulate a pixel data of the still image by the gain; and a display panel drive circuit configured to write the pixel data received from the controller to sub-pixels of the display panel, wherein the gain is set to be a different value on a different position on the display panel, and the peak luminance and the current are gradually lowered in the sub-pixels while the still image is displayed, wherein the gain is set to 1 for a preset reference point on the display panel, and the gain is set to a value of less than 1 at a position where the peak luminance is lower than the reference point, and wherein the gain has an absolute value that is gradually increases over time at positions other than the reference point while the still image is displayed.

11. The display device of claim 10, wherein the pixel data to be written to each sub-pixel is multiplied by the gain.

12. The display device of claim 10, wherein the controller comprises:

an average luminance calculator configured to calculate an average luminance of the input image for each frame;

a peak luminance controller configured to output a preset peak luminance value corresponding to the average luminance;

a luminance adjuster configured to output the gain while the still image is displayed; and a gain applier configured to modulate the pixel data of by the gain.

13. The display device of claim 12, wherein the gain further comprises:

a first gain for decreasing the luminance of an entire display area of the display panel while the still image is displayed; and a second gain for adjusting the peak luminance with respect to the reference point on the display panel such that the peak luminance of sub-pixel at positions other than the reference point is equal to the peak luminance of sub-pixel at the reference point.

* * * * *